US009115964B2

(12) United States Patent
Facciano et al.

(10) Patent No.: US 9,115,964 B2
(45) Date of Patent: Aug. 25, 2015

(54) INTEGRAL INJECTION THRUST VECTOR CONTROL WITH BOOSTER ATTITUDE CONTROL SYSTEM

(71) Applicant: Raytheon Company, Waltham, MA (US)

(72) Inventors: Andrew B Facciano, Tucson, AZ (US); Michael S Alkema, Sahuarita, AZ (US); Michael A Leal, Tucson, AZ (US); Daniel Chasman, Tucson, AZ (US); Robert T Moore, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 148 days.

(21) Appl. No.: 14/141,714

(22) Filed: Dec. 27, 2013

(65) Prior Publication Data

US 2015/0184988 A1 Jul. 2, 2015

(51) Int. Cl.

| | |
|---|---|
| ***F42B 10/66*** | (2006.01) |
| ***F42B 15/01*** | (2006.01) |
| *F42B 10/00* | (2006.01) |
| *F42B 10/60* | (2006.01) |

(52) U.S. Cl.

CPC ..... *F42B 15/01* (2013.01); *F42B 10/663* (2013.01); *F42B 10/60* (2013.01); *F42B 10/66* (2013.01)

(58) Field of Classification Search

CPC ..... F02K 9/80; F02K 9/82; F02K 9/84; F42B 10/60; F42B 10/66; F42B 10/663; F42B 10/665; F42B 10/666; F42B 10/668; F42B 15/01

USPC ..... 244/3.1, 3.15, 3.21, 3.22; 60/200.1, 60/228, 230, 231, 232; 239/265.11, 239/265.15, 265.17, 265.19, 265.23, 239/265.25, 265.27, 265.29, 265.31

See application file for complete search history.

(56) References Cited

U.S. PATENT DOCUMENTS

| | | | | | |
|---|---|---|---|---|---|
| 2,965,334 | A | * | 12/1960 | McCullough, Jr. et al. | 244/3.22 |
| 3,046,736 | A | * | 7/1962 | Thomson | 60/232 |
| 3,091,924 | A | * | 6/1963 | Wilder, Jr. | 60/231 |
| 3,092,963 | A | * | 6/1963 | Lawrence | 60/231 |
| 3,101,591 | A | * | 8/1963 | Wise | 60/231 |
| 3,121,312 | A | * | 2/1964 | Hopper | 60/231 |
| 3,147,590 | A | * | 9/1964 | Thielman | 239/265.15 |
| 3,273,801 | A | * | 9/1966 | Wilhite | 244/3.22 |
| 3,302,884 | A | * | 2/1967 | Robinson | 244/3.22 |
| 3,446,023 | A | * | 5/1969 | Mosier | 244/3.22 |
| 3,568,954 | A | * | 3/1971 | McCorkle, Jr. | 244/3.22 |

(Continued)

*Primary Examiner* — Bernarr Gregory

(74) *Attorney, Agent, or Firm* — Renner, Otto, Boisselle & Sklar, LLP

(57) ABSTRACT

A projectile includes a propulsion booster for producing pressurized gases, a nozzle for expelling the pressurized gases produced by the booster, and a supplementary integrated actuation system. The integrated actuation system selectively directs propellant from a storage reservoir of the integrated actuation system through an interiorly-located outlet of the integrated actuation system located at the nozzle and into the nozzle, thus changing a direction of the pressurized gases expelled by the booster. The integrated actuation system also selectively directs propellant from the storage reservoir through a peripherally-located outlet of the integrated actuation system, to produce thrust at an external periphery of the projectile, thus diverting the projectile. The integrated actuation system may also selectively direct propellant to a nozzle actuation system for positioning the nozzle, to a stage separation system for separating portions of the projectile, or to a power generator for generating electric power for the projectile.

20 Claims, 10 Drawing Sheets

(56) References Cited

U.S. PATENT DOCUMENTS

| | | | | | |
|---|---|---|---|---|---|
| 3,614,027 | A | * | 10/1971 | Lewis | 244/3.22 |
| 3,740,003 | A | * | 6/1973 | Ayre et al. | 244/3.22 |
| 3,802,190 | A | * | 4/1974 | Kaufmann | 244/3.22 |
| 4,413,795 | A | * | 11/1983 | Ryan | 244/3.22 |
| 4,482,107 | A | * | 11/1984 | Metz | 244/3.22 |
| 4,856,734 | A | * | 8/1989 | Davies | 244/3.22 |
| 5,062,593 | A | * | 11/1991 | Goddard et al. | 244/3.22 |
| 5,456,425 | A | * | 10/1995 | Morris et al. | 244/3.22 |
| 5,511,745 | A | * | 4/1996 | Faupell et al. | 244/3.22 |
| 6,267,326 | B1 | * | 7/2001 | Smith et al. | 244/3.22 |
| 8,735,788 | B2 | * | 5/2014 | Preston et al. | 244/3.22 |

* cited by examiner

INTEGRAL INJECTION THRUST VECTOR CONTROL WITH BOOSTER ATTITUDE CONTROL SYSTEM

FIELD OF INVENTION

The present invention relates generally to a projectile, and more particularly to a projectile with integrated thrust vector and attitude control systems.

BACKGROUND

Ballistic missiles often include a flight vehicle and at least one propulsion stage coupled to the flight vehicle. Such ballistic missiles are often stored in a launch canister for loading into a launch tube of a launch system, or a launcher. A "round," a launch canister and a ballistic missile, often has a specific and inflexible weight requirement resulting from "load-out" capabilities of the launch system or of the armament or vehicle where the launch system is located, such as on a warship. The round weight requirement is divided between the launch canister and the ballistic missile. The weight of the launch canister is driven by the requirement for a protective launch canister, while the weight of the ballistic missile is largely driven by the amount of propellant and necessary componentry, such as systems of actuators and batteries, thrust vector controls, and attitude controls.

Such systems control separate functions of missile launch and flight and typically have separate power sources. For example, the propulsion stage of a projectile enables egress from a launch canister and launch system, movement away from the launch system, and movement towards a target. Thrust vector controls enable control of pitch and yaw during propulsion stage burn and initial flight vector alignment, and attitude controls enable control of subsequent, slight pitch, yaw, and roll adjustments. These systems also often require complex assembly integration, include numerous single point failure sources, and add significant projectile weight and size. Accordingly, there is a need for a projectile having systems allowing for balancing of the projectile's external profile, total round weight, system integration difficulty, and failure point risk concerns.

SUMMARY OF INVENTION

According to one aspect of the invention, a projectile includes a propulsion booster for producing pressurized gases, a nozzle for expelling the pressurized gases produced by the booster, and a supplementary integrated actuation system for storing and directing propellant. The integrated actuation system selectively directs propellant from a storage reservoir of the integrated actuation system through an interiorly-located outlet of the integrated actuation system located at the nozzle and into the nozzle, thus changing a direction of the pressurized gases expelled by the booster. The integrated actuation system also selectively directs the propellant from the storage reservoir through a peripherally-located outlet of the integrated actuation system, to produce additional thrust at an external periphery of the projectile, thus diverting the projectile.

The integrated actuation system may include a set of supply channels for directing the propellant from the storage reservoir out through the interiorly-located outlet and into the nozzle, where the set of supply channels is selectively open to the internal periphery of the nozzle, and another set of supply channels for directing the propellant from the storage reservoir out through the peripherally-located outlet, where the other set of supply channels is selectively open to the external periphery of the projectile in a direction substantially orthogonal to a direction of thrust from the nozzle.

The projectile may include a fuselage flange at least partially surrounding the propulsion booster, where the fuselage flange defines an external opening, and where the peripherally-located outlet opens to the external opening. The propellant may be a pressurized liquid. The propulsion booster may contain additional propellant, burning of the additional propellant may cause a thrust plume to be outwardly directed from the nozzle, and injection into the nozzle of propellant from the storage reservoir may alter the direction of the thrust plume.

The projectile may include valves for selectively opening the set of supply channels and the other set of supply channels. The projectile may include valves that control flow between the storage reservoir and the interiorly-located outlet and between the storage reservoir and the peripherally-located outlet. The storage reservoir may extend circumferentially around the nozzle.

The projectile may include a power generator for generating electric power for the projectile using propellant from the storage reservoir. The projectile may include a manifold, where the power generator is coupled between the storage reservoir and the manifold, and where the power generator generates electric power during flow of propellant between the storage reservoir and the manifold. The projectile may also include a nozzle actuation system coupled to the nozzle, where the integrated actuation system selectively directs propellant from the storage reservoir to the nozzle actuation system, to position the nozzle.

The projectile may include a stage separation system for separating portions of the projectile from one another, where the integrated actuation system selectively directs propellant from the storage reservoir to the stage separation system for separating the portions of the projectile. The integrated actuation system may include a gas generator attached to the storage reservoir for burning propellant in the storage reservoir, thereby releasing gas into the integrated actuation system.

According to another aspect of the invention, there is an integrated actuation system for a projectile including a body and a nozzle coupled to the body for directing a thrust plume expelled from the body. The integrated actuation system includes a storage reservoir containing propellant, an initial flow passage extending between the storage reservoir and an internal periphery of the nozzle, and an auxiliary flow passage extending between the storage reservoir and an external periphery of the body. Propellant from the integrated actuation system is selectively directed through the initial flow passage thereby altering the direction of the thrust plume expelled from the body or through the auxiliary flow passage thereby altering the attitude and/or roll of the projectile.

The integrated actuation system in combination with a projectile including a body, a nozzle coupled to the body for directing a thrust plume expelled from the body, and a nozzle actuation system. The integrated actuation system may be operatively coupled to a nozzle actuation system for moving the nozzle. The integrated actuation system in combination with a projectile including a body, a nozzle coupled to the body for directing a thrust plume expelled from the body, and a stage separation system. The integrated actuation system may be operatively coupled to a stage separation system for separating portions of the projectile from one another. The storage tank may surround the nozzle. The propellant may be a pressurized fluid.

According to yet another aspect of the invention, a method of altering a flight vector of a projectile includes maneuvering the projectile by using fluid from a storage reservoir of the projectile to alter the direction of a thrust plume expelling from the nozzle, and where movement of fluid to an external periphery of the projectile alters the attitude and/or roll of the projectile. The method may also include moving the nozzle by moving fluid from a storage reservoir to a nozzle actuation system for moving the nozzle.

The foregoing and other features of the invention are hereinafter described in greater detail with reference to the accompanying drawings.

BRIEF DESCRIPTION OF THE DRAWINGS

The annexed drawings, which are not necessarily to scale, show various aspects of the invention.

DETAILED DESCRIPTION

The present invention provides a projectile including a propulsion booster for producing pressurized gases, a nozzle for expelling the pressurized gases produced by the booster, and an integrated actuation system integrating at least thrust vector controls and attitude controls. The integrated actuation system selectively directs propellant from a storage reservoir of the integrated actuation system through an interiorly-located outlet of the integrated actuation system located at the nozzle and into the nozzle, thus changing a direction of the thrust from the booster. The integrated actuation system also selectively directs propellant from the storage reservoir through a peripherally-located outlet of the integrated actuation system, to produce additional thrust at an external periphery of the projectile, thus diverting the projectile.

The integrated actuation system may also selectively direct propellant to a nozzle actuation system for positioning the nozzle, to a stage separation system for separating portions of the projectile from one another, or to a power generator for generating electric power for the projectile.

The projectile may be a missile, interceptor, vehicle, guided projectile, or unguided projectile, and thus will be described below chiefly in this context. The invention may also be useful in other applications including pyrotechnics, satellites, sub-munitions, and other booster-propelled projectiles.

Figure 1:
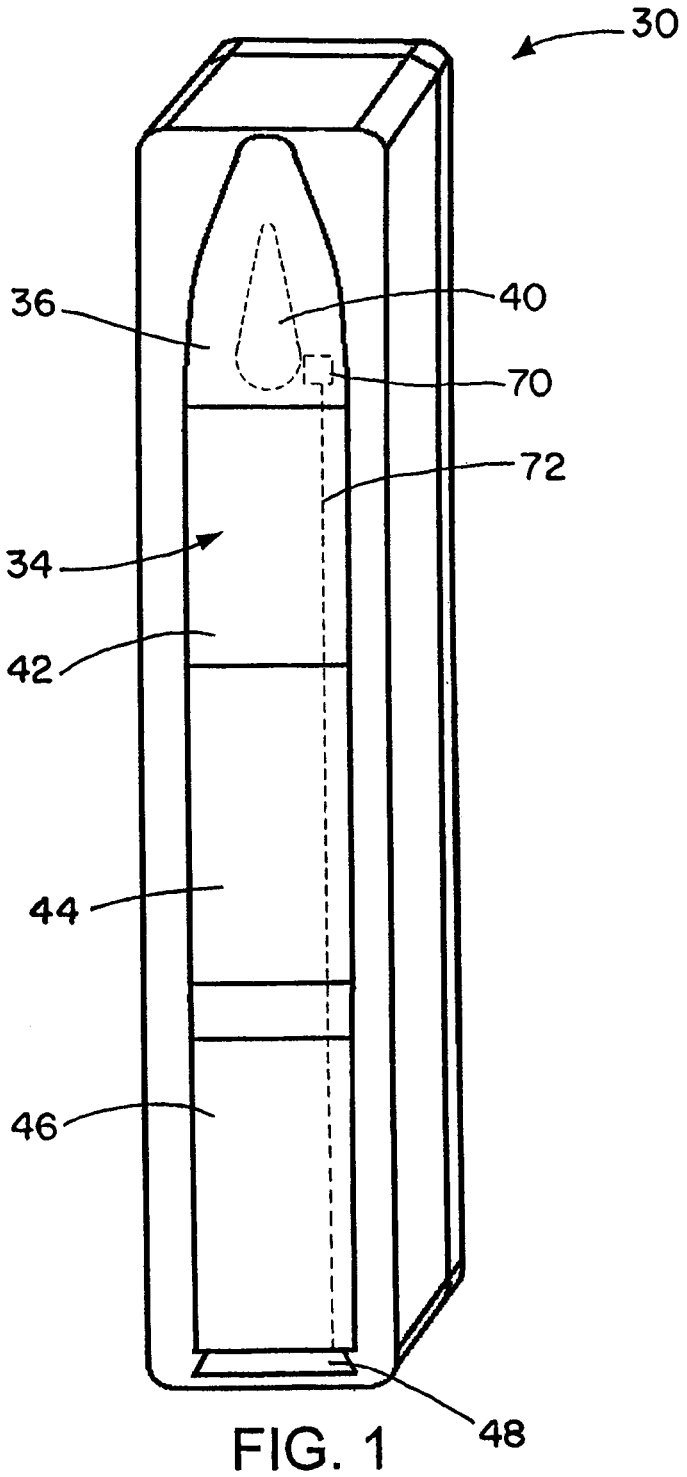
FIG. 1 is a cutaway view of an exemplary projectile system including a projectile and projectile launch canister.
Figure 2:
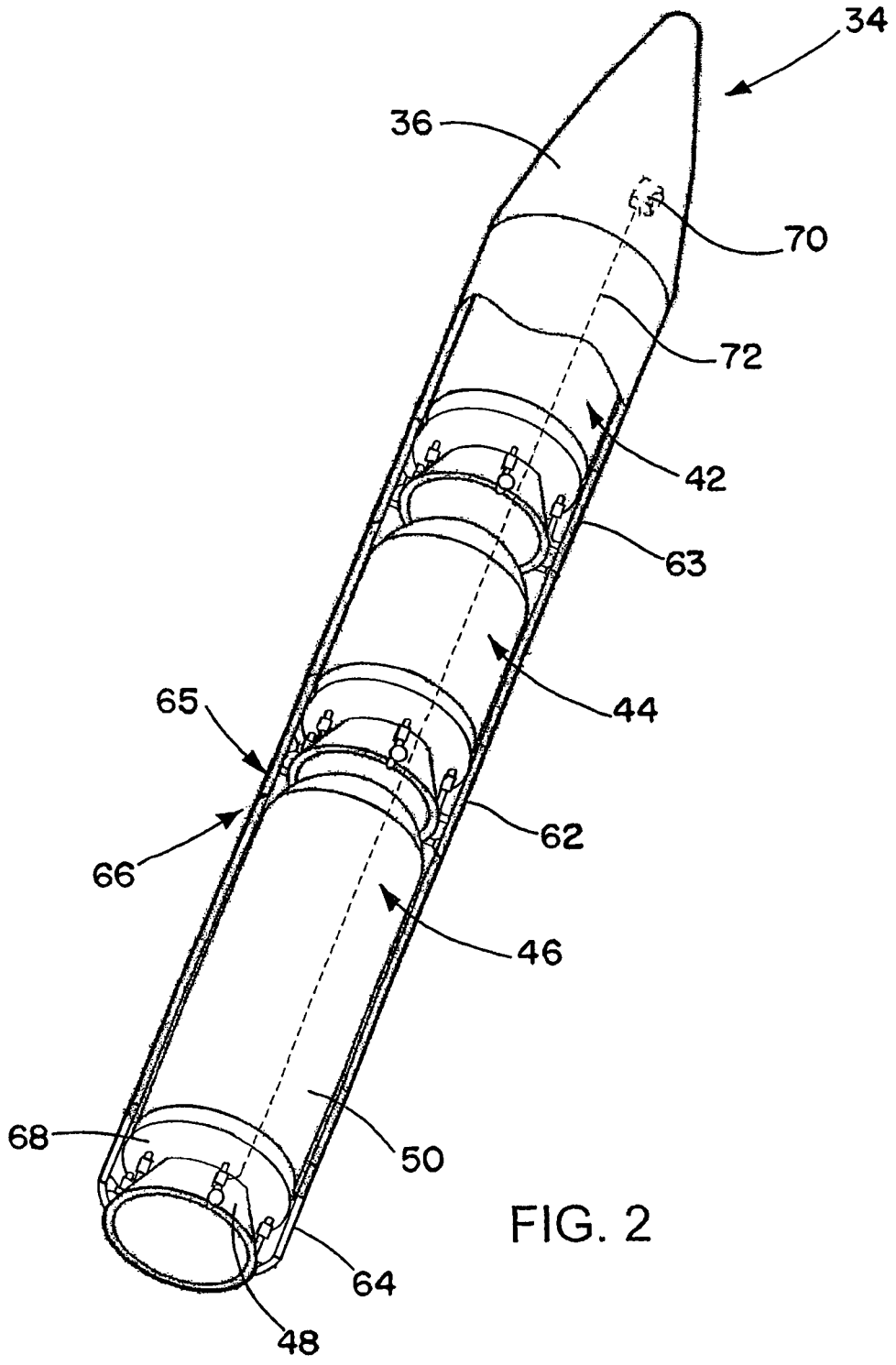
FIG. 2 is a partial cutaway view of the exemplary projectile of FIG. 1.
Figure 3:
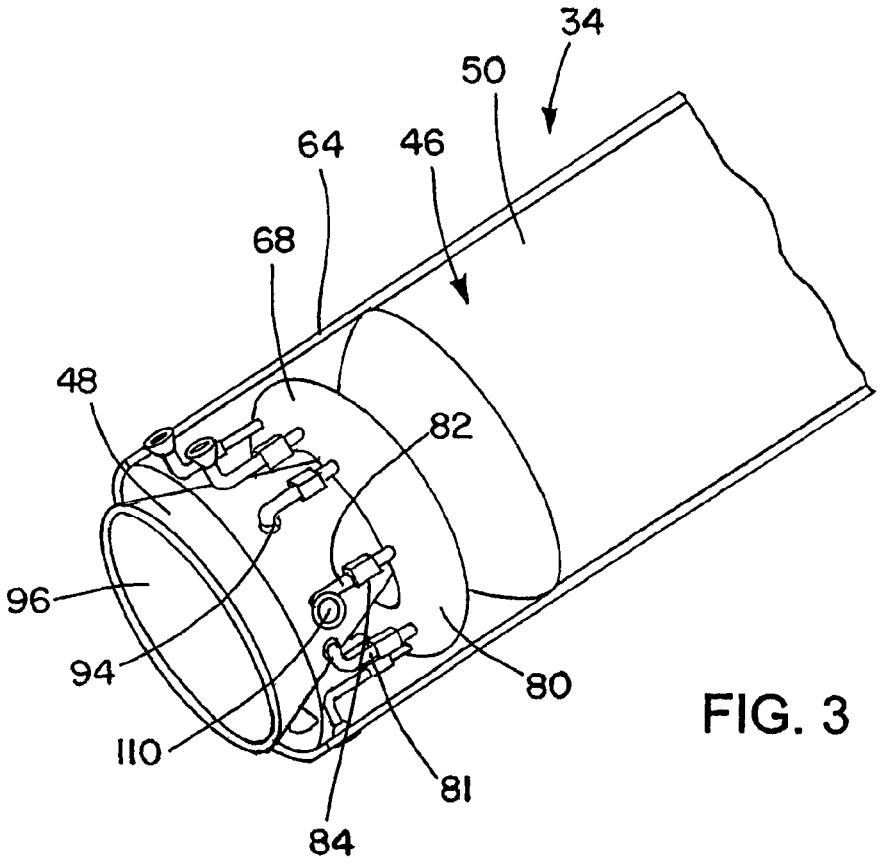
FIG. 3 is a partially transparent perspective view of part of the exemplary projectile of FIG. 1.
Figure 4:
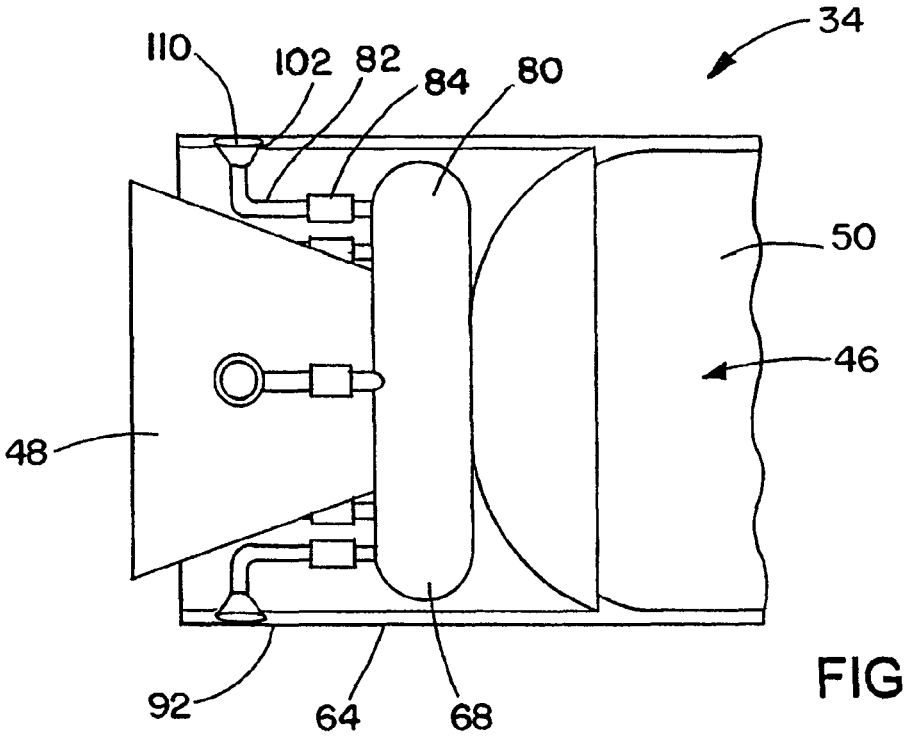
FIG. 4 is a partially transparent side view of part of the exemplary projectile of FIG. 1.
Figure 5:
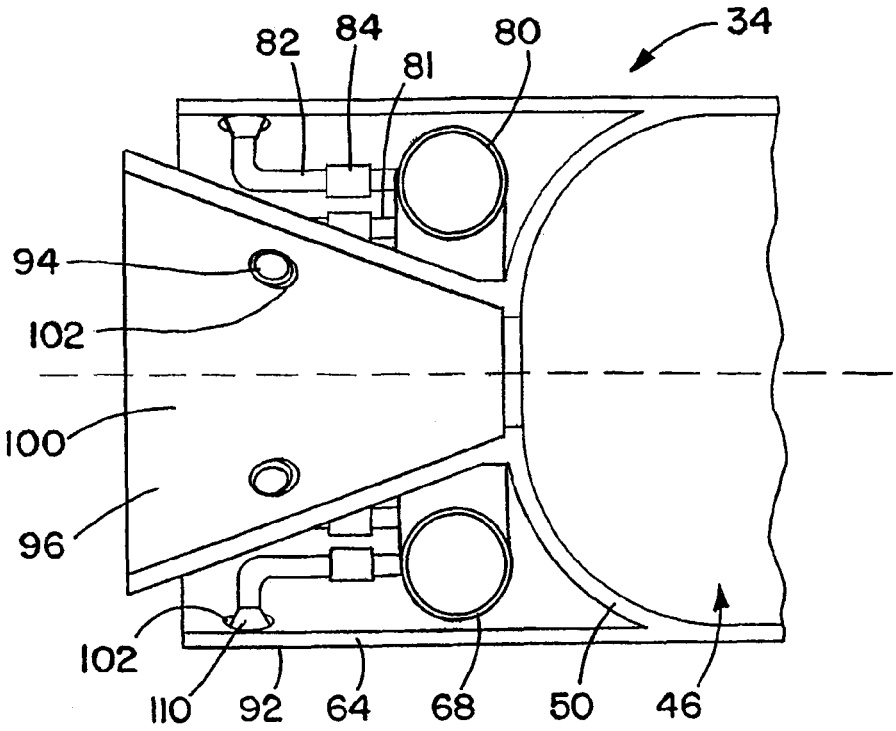
FIG. 5 is a cross-sectional side view of part of the exemplary projectile of FIG. 1.
Figure 6:
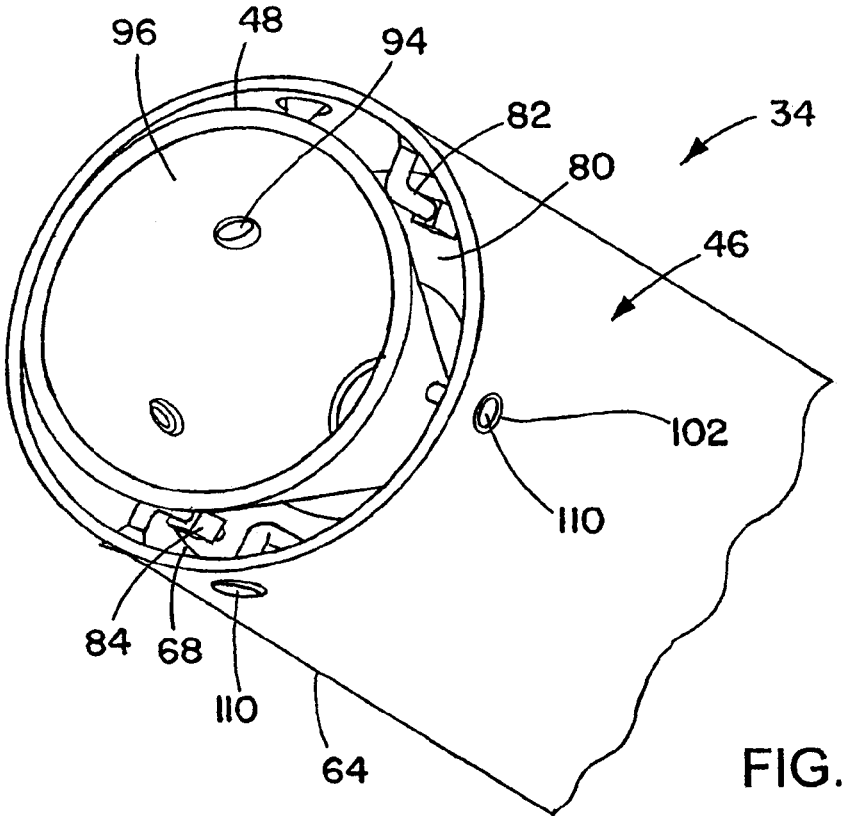
FIG. 6 is a rear view of part of the exemplary projectile of FIG. 1.
Figure 7:
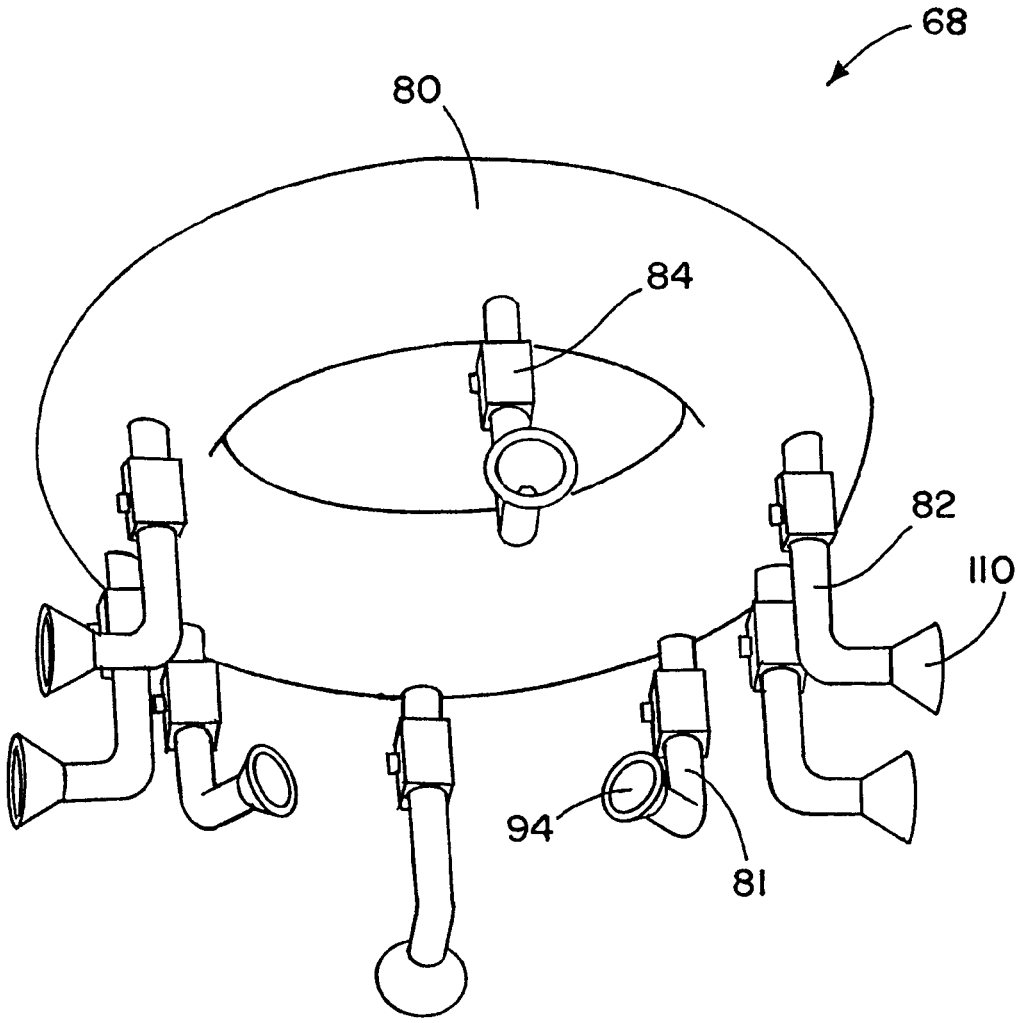
FIG. 7 is a perspective view of an integrated actuation system for use with the exemplary projectile of FIG. 1.
Figure 8:
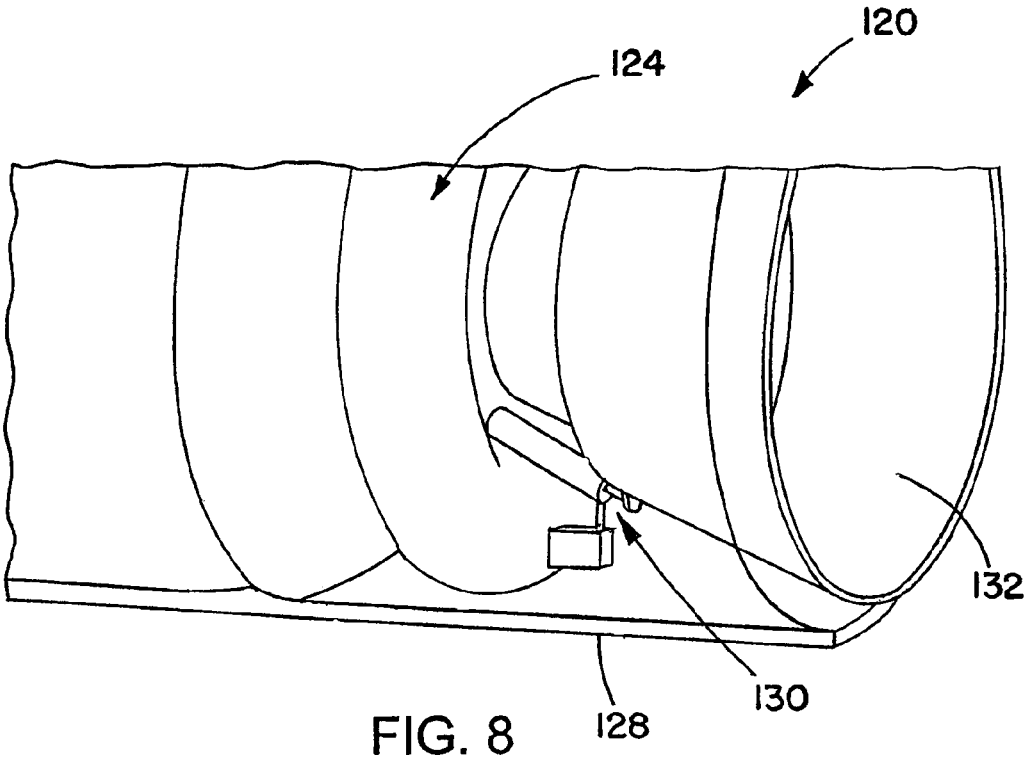
FIG. 8 is a partially transparent side view of part of an exemplary projectile showing an exemplary nozzle actuation system with the nozzle retracted.
Figure 9:
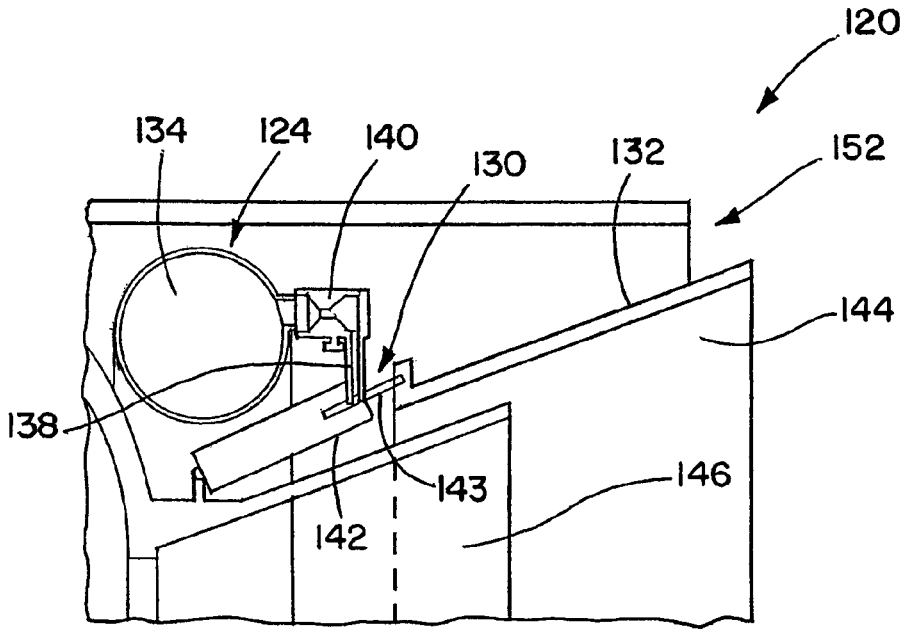
FIG. 9 is a cross-sectional view of the part of the exemplary projectile of FIG. 8.

Referring now in detail to the drawings and initially to FIGS. 1 and 2, an exemplary projectile system 30 according to the invention and for loading into a launcher is shown. The projectile system 30 includes an outer launch canister 32 for housing or storing a projectile 34 to be fired from the canister 32. The projectile 34 is positioned completely interior to the launch canister 32, although it will be appreciated that the projectile 34 may instead be positioned only partially interior to the launch canister 32.

The projectile 34 includes a nosecone 36 for housing a flight vehicle 40, such as a warhead, explosive, payload, sub-projectile, sensor array, or other package. Three propulsion stages are coupled adjacent the nosecone 36 for storing propellant to be ignited to provide propulsion. The propulsion stages include an upper propulsion stage 42, an intermediate propulsion stage 44, and a lower propulsion stage 46 adjacent the nosecone 36, stacked longitudinally in that order for being ignited in the opposite order. It will be appreciated that any suitable number of propulsion stages may be utilized.

The propulsion stages 42, 44, and 46 contain propellant enclosed therein, such as solid fuel or fluid fuel, including liquid or gaseous fuel, or any combination thereof. Each of the propulsion stages 42, 44, and 46 may include the same propellant as, or a propellant different from, any other of the propulsion stages 42, 44, and 46. Each stage 42, 44, and 46 also includes a booster for storing the propellant and a nozzle operatively coupled to the booster for expelling pressurized gases produced by burning the propellant. For example, a lower nozzle 48 is operatively coupled to a lower booster 50 of the lower propulsion stage 46.

The propulsion stages 42, 44, and 46 may also include fuselage flanges, such as flanges 62, 63, and 64, for coupling propulsion stages to one another or for protecting projectile systems. The flanges may also make the projectile 34 more aerodynamic by providing a substantially uniform outer profile.

The flange 62 is integral with, such as attached to, the propulsion stages 44 and 46. As shown, the flange 62 surrounds the intermediary propulsion stage 44, and extends between a rear end 65 of the intermediary propulsion stage 44 and a forward end 66 of the lower propulsion stage 46. Thus, the flange 62 provides an extension of the propulsion stage 44, thereby providing structure to enable coupling, such as by a ring and groove joint, of the intermediary propulsion stage 44 to the lower propulsion stage 46.

Likewise, the flange 63 is integral with the propulsion stages 42 and 44. The flange 63 surrounds the upper propulsion stage 42 and extends toward the intermediary propulsion stage 44. The flange 64 is integral with the lower propulsion stage 46 and protects projectile systems, such as the lower integrated actuation system 68, to be further discussed later.

The projectile further includes an integrated actuation system operatively coupled to each of the propulsion stages 42, 44, and 46 for storing and releasing propellant or pressurant, herein referred to jointly as propellant, such as methane, or any other suitable propellant. Through release of the propellant from the integrated actuation system, thrust vector may be controlled via manipulation of the direction of thrust from the propulsion stage. Attitude may also be controlled via the release of the propellant, thus altering orientation of the projectile with respect to an inertial frame of reference. For example, a lower integrated actuation system 68 for controlling thrust vector and attitude is operatively coupled to the lower propulsion stage 46, and will be discussed in greater detail with reference to FIGS. 3-7. Any number of integrated actuation systems may be utilized in conjunction with any number of propulsion stages, and the one or more integrated actuation systems may be located in any suitable location of the projectile. The propellant stored in the integrated actuation systems may be the same propellant stored in any of the propulsion stages 42, 44, and 46, or it may be a different propellant.

The projectile 34 may also include a guidance and control system, such as a controller 70. The controller 70 may be mounted in the nosecone 36, included in the flight vehicle 40, or otherwise located in another suitable location of the projectile 34. The controller 70 is communicatively coupled to the propulsion stages 42, 44, and 46 for controlling timing of ignition of the propellant within the stages and for directing the projectile 34 towards a desired destination. The controller 70 is also communicatively coupled to the integrated actuation systems, such as the integrated actuation system 68, for controlling the integrated actuation system 68, and thereby controlling thrust vector and attitude of the projectile 34. The controller 70 may utilize a variety of different data in order to direct the projectile 34. As an example, the desired destination of the projectile 34 may be a location of a target, and more specifically, the desired destination may be a continually changing location of a moving target, such as a ballistic missile.

A communications connection 72, such as a wire or fiber optic cable, extends longitudinally along the projectile 34 between the controller 70 and the propulsion stages and integrated actuation systems, thereby allowing communication therebetween. Alternatively, the projectile 34 may also include additional communications connections, or the communications connection 72 may be omitted and communication may instead be wireless or of any other suitable type.

Turning now to FIGS. 3-7, the integrated actuation system 68 is shown in detail. The integrated actuation system 68 includes a storage tank, such as a storage reservoir 80, for storing the propellant, which may be in solid form or fluid form, such as gas or liquid form, or any combination thereof. The propellant may also be in a pressurized state. The storage reservoir 80 has a toroidal shape and extends circumferentially around the nozzle 48, such as surrounding an upper portion of the nozzle 48. Alternatively, the storage reservoir 80 may be of any suitable shape and located in another suitable location of the projectile 34. Additional storage reservoirs may also be included or the storage reservoir 80 may be operatively connected to an adjacent propulsion stage for selectively siphoning propellant from the propulsion stage into the storage reservoir 80.

The projectile 34 may also include a gas generator (not shown separately) integral with the storage reservoir 80 and located at least partially internal to the storage reservoir 80. The gas generator, such as a warm or cold gas generator, is integral with the storage reservoir 80 for burning a liquid or solid propellant to produce gases for release into the integrated actuation system 68 and for subsequent delivery to portions of the projectile 34 for providing thrust vector and attitude control.

Numerous supply channels, such as a first or initial set of supply channels 81 and a second or auxiliary set of supply channels 82, are connected to the storage reservoir 80. The sets of supply channels 81 and 82 provide flow or fluid communication, including gaseous communication, liquid communication, or any combination of the two, between the storage reservoir 80 and outlets of the sets of supply channels 81 and 82. Each set of supply channels 81 and 82 may include any number of supply channels, and the sets of supply channels 81 and 82 may be fluidly interconnected. The sets of supply channels 81 and 82 include valves 84 for controlling the fluid flow and for allowing the integrated actuation system 68 to selectively direct propellant to the outlets. The valves 84 may be controlled by the control system 70 or any other suitable control system. The outlets of the integrated actuation system 68 allow for delivery of propellant into the nozzle 48 and to an external periphery 92 of the projectile 34.

Interiorly-located outlets 94 of the first set of supply channels 81 open to an internal periphery 96 of the nozzle 48 for changing a direction of the thrust plume 100, thereby maneuvering or diverting the projectile 34. In this way, the integrated actuation system 68 serves as a thrust vector control subsystem. Accordingly, burning of the propellant in the booster 50 of the lower propulsion stage 46 causes the thrust plume 100 to be outwardly directed from the nozzle 48. Upon release of propellant from the storage reservoir 80, or burning of liquid or solid propellant in the storage reservoir 80 via the gas generator to produce propellant gas, the resulting propellant is delivered through one or more channels of the first set of supply channels 81 to the interiorly-located outlets 94 via opening of associated valves 84 in the first set of supply channels 81. Injection or release of an auxiliary plume 102 of the resulting propellant from one or more of the interiorly-located outlets 94 and flow into the nozzle 48 causes the direction or angle of the thrust plume 100 to be altered. The direction or angle of the thrust plume 100 is altered via interaction, such as kinetic, chemical, or thermal interaction, or any combination of any of the three, of the auxiliary plume 102 with the thrust plume 100.

Use of propellant from the storage reservoir 80 to direct the thrust plume 100 provides advantages over other thrust vectoring methods, such as the use of gimbaled nozzles. Typical gimbaled nozzles involve flex seals or ball and socket joints so the nozzle may be gimbaled upon thrust vector control actuation. Both flex seals and ball and socket joints are temperature sensitive, limiting thrust vector control performance and leading in many cases to nozzle failures. Both types of gimbaled systems require a series of material layers that thermally expand at different rates during the inter-pulse delay, when the heat from the first pulse burn soaks though the nozzle material layers. Additionally, debonding, cracking, and delamination may ensue resulting in nozzle failure when the second pulse is ignited. As such, the thrust vector control subsystem of the integrated actuation system 68 mitigates these issues by integrating the thrust vector controls into the system 68, enabling greater survivability and better performance of the thrust vector controls.

Peripherally-located outlets 110 of the second set of supply channels 82 open to the external periphery 92 of the projectile 34 at external openings 102 defined by the flange 64. As shown, the peripherally-located outlets 110 open in a direction substantially orthogonal to a direction of the thrust from the nozzle 48, although they may open in any other suitable direction. Release of propellant through the outlets 110 produces additional thrust, thereby maneuvering or diverting the projectile 34, such as by altering attitude, flight angle, or roll of the projectile 34. In this way, the integrated actuation system 68 serves as an attitude control subsystem. Accordingly, upon release of resulting propellant gas from the storage reservoir 80 of the integrated actuation system 68, the propellant gas flows into the second set of supply channels 82. Upon opening of associated valves 84 in the second set of supply channels 82, an auxiliary plume 102 of the resulting propellant is released from one or more peripherally-located outlets 110, enabling attitude and/or roll control of the projectile 34.

The projectile 34 has numerous advantages over projectiles having non-integrated or uncombined systems, such as uncombined thrust vector control and attitude control subsystems. The integration of control subsystems to a single actuation source, such as the propellant of the integrated actuation system 68, results in a significant deletion of redundant hardware, such as passages, actuators, and batteries. The integrated actuation system 68 also enables efficient manufacture and reliability at a lower cost. For instance the system 68 reduces part count and simplifies assembly integration with a projectile thereby increasing reliability. Combining these critical control subsystems may also reduce weight and eliminate many single point failure sources, which are desired traits for deployment and performance of projectiles, such as missiles.

Projectiles using the integrated actuation system 68 also have greater mission flexibility. For example, the lower propulsion stage 46 may have more compact hardware due to integration of systems, and thus may provide more longitudinal volume for more booster propellant. This may be particularly important for length constrained, encanistered missiles, such as ballistic missile defense interceptors.

Integration of the power actuation sources for the entire system—using the propellant in the storage reservoir 80—also achieves efficient power source utilization. As compared with projectiles having separate control subsystems, and therefore increased wasted or unused power source, the integrated actuation system 68 wastes minimal power source. For instance, excess propellant not used by the initial thrust vector control operation is available for other control subsystem operations, such as attitude control operation, providing more flexibility for longer interceptor coast or aerodynamic maneuvering after lower propulsion stage booster burn out.

Turning now to FIGS. 8-11, another exemplary projectile 120 having an integrated actuation system 124 is shown. The integrated actuation system 124 may be used in place of the integrated actuation system 68 (FIGS. 1-7), and the discussion below omits many features of the projectile 120 and integrated actuation system 124 that are similar to those of the projectile 34 (FIGS. 1-7) and associated integrated actuation system 68. In addition, features of the integrated actuation system 124 may be combined with those of the integrated actuation system 68.

Figure 10:
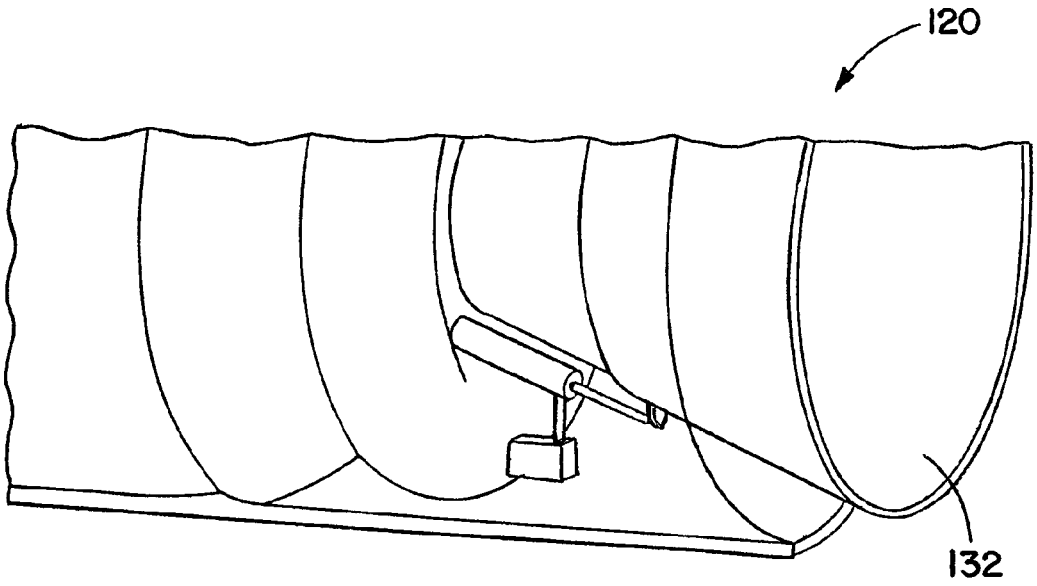
FIG. 10 is another partially transparent side view of the part of the projectile of FIG. 8 showing the exemplary nozzle actuation system with the nozzle extended.
Figure 11:
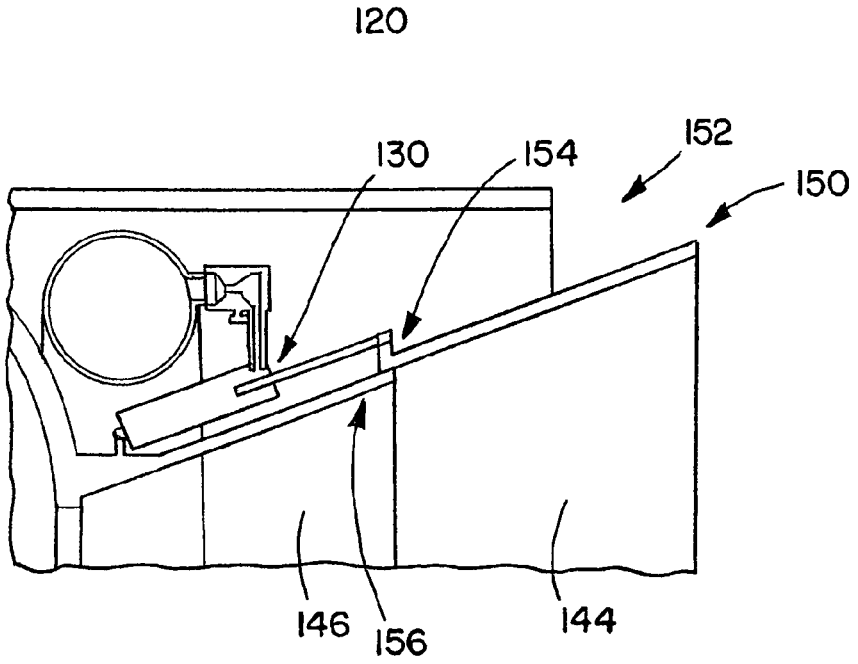
FIG. 11 is another cross-sectional view of the part of the exemplary projectile of FIG. 8.

As shown, the integrated actuation system 124 is in fluid communication with a nozzle actuation system 130 for positioning or moving, such as rotating or extending, a nozzle 132 of the projectile 120. Thus in addition to supply channels for selectively directing propellant to the nozzle 132 and to the external periphery 128 of the projectile 120, the integrated actuation system 124 may have a set of supply channels 136, in turn having valves 140, for selectively directing propellant from the storage reservoir 134 to the nozzle actuation system 130. The nozzle actuation system 130 may include actuators 142, such as piston-cylinder assemblies, for extending the nozzle 132 from a retracted position (FIGS. 8 and 9) to an extended position (FIGS. 10 and 11). The actuators 142 may also include a locking mechanism, such as a lock 143, for locking the actuator 142 in the extended position after initial propellant flow from the storage reservoir 134.

Accordingly, delivery of propellant from the storage reservoir 134 to one or more actuators 142 may cause the one or more actuators 142 to extend. Extension of the actuators 142 thereby causes an outer cuff 144 of the nozzle 132 to extend axially away from an inner cuff 146. In this way, the outer cuff 144 extends axially away from the inner cuff 146 between the retracted position, where the outer cuff 144 is located around the inner cuff 146, and the extended position. At the extended position, a rear end 150 of the outer cuff 144 extends from the rear end 152 of the projectile 120. Also in the extended position, a forward end 154 of the outer cuff 144 mates with a rear end 156 of the inner cuff 146, providing a seal between the inner and outer cuffs 146 and 144. Alternatively, the inner and outer cuffs 146 and 144 may be separated from one another with the forward end 154 located adjacent the rear end 156.

As compared with typical nozzle extension systems, the nozzle actuation system 130 is not actuated by electro-mechanical actuators with separate batteries. Instead, the nozzle actuation system 130 of the integrated actuation system 124 uses high pressure propellant from the same storage reservoir as the thrust vector control and attitude control subsystems of the integrated actuation system 124.

Figure 12:
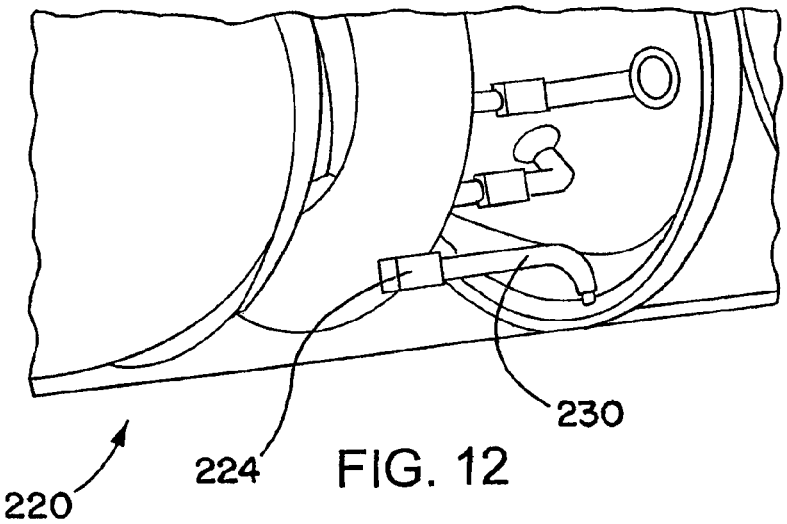
FIG. 12 is a partially transparent side view of part of an exemplary projectile showing a stage separation system.
Figure 13:
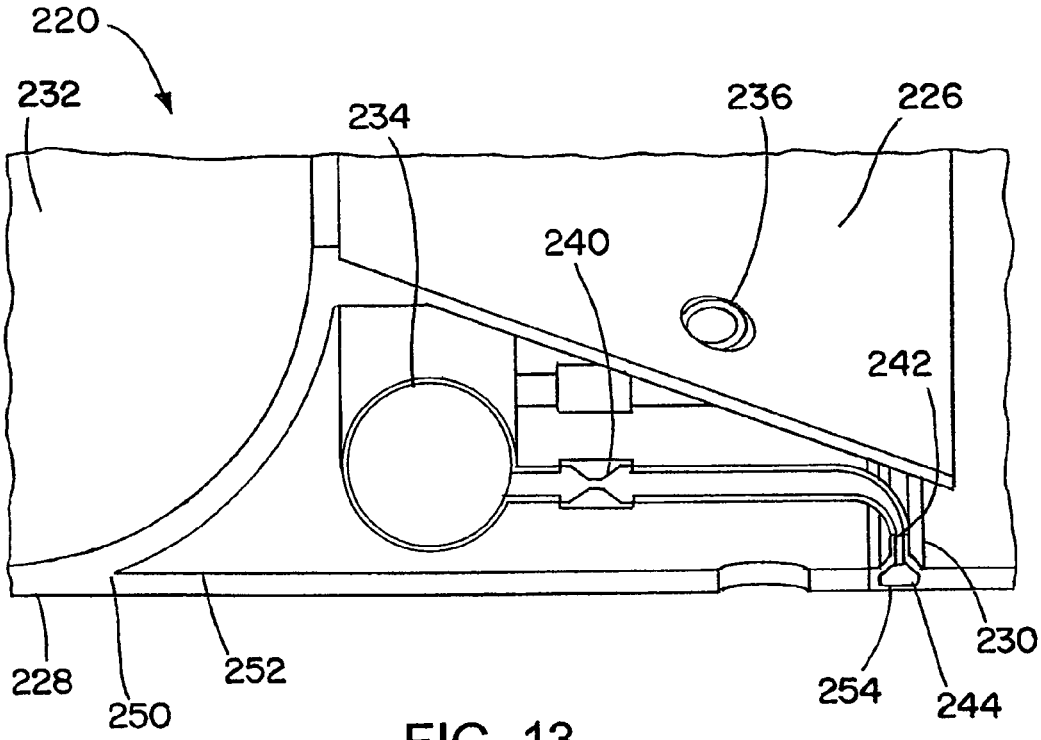
FIG. 13 is a cross-sectional view of the part of the exemplary projectile of FIG. 12.
Figure 14:
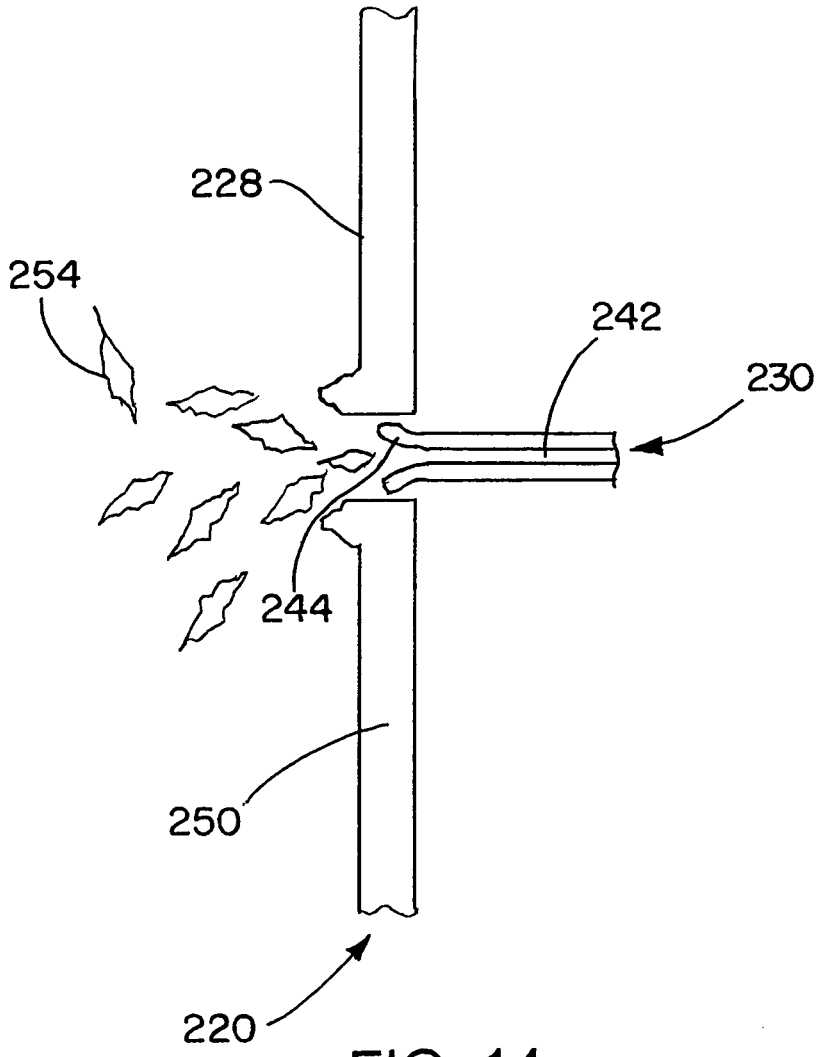
FIG. 14 is another cross-sectional view of the part of the exemplary projectile of FIG. 12 illustrating the stage separation system in use.

FIGS. 12-14 show another exemplary projectile 220 having an integrated actuation system 224. The integrated actuation system 224 may be used in place of any other integrated actuation system described herein and/or features of the integrated actuation systems may be combined.

As shown, the integrated actuation system 224 is in fluid communication with a stage separation system 230 for separating portions of the projectile 220 from one another. For example, the stage separation system 230 may enable a lower propulsion stage 232 to separate from a remainder of the projectile 224 upon exhaustion of propellant contained in the propulsion stage 232. It will be appreciated that the stage separation system 230 may be included to separate any portion of the projectile 220 from the remainder of the projectile 220.

In addition to sets of supply channels for selectively directing propellant to the nozzle 226 and to the external periphery 228 of the projectile 220, the integrated actuation system 224 may have a set of supply channels 236, in turn having valves 240, for selectively directing propellant from the storage reservoir 234 to the stage separation system 230. The stage separation system 230 may include a passage 242 providing fluid communication between the channels 236 and a separation cavity 244 of the stage separation system 230. The separation cavity 244 may be defined by a wall 250 of the fuselage flange 252, and the wall 250 may have a frangible portion 254. Alternatively, the passage 242 may be operatively coupled to the frangible portion 254 and the cavity 244 may be omitted.

Upon actuation of the stage separation system 230, including delivery of propellant from the storage reservoir 234 to the cavity 244 and frangible portion 254, the frangible portion 254 is caused to break via kinetic, chemical, or thermal interaction, or any combination of the three. In this way, the fuselage flange 252 may be fractured such that the lower propulsion stage 232 is allowed to separate from the remainder of the projectile 220. One or more stage separation systems 230 may be operatively coupled to the integrated actuation system 224 to provide for breaking of numerous frangible portions 254, thus enabling separation of the lower propulsion stage 232.

The stage separation system 230 of the integrated actuation system 224 provides for less variable separation characteristics than a typical pyrotechnic device, particularly during a stage in a projectile's flight when the projectile is prone to aerodynamic instability. Such typical pyro-initiated devices require internal fail-safe electronics and multiple batteries, increasing design complexity, assembly complications, cost, weight, and failure points of the projectile. The high number of pyro-initiated devices and power supplies necessary to separate a propulsion stage from a remainder of the projectile will also require more communication cabling and routing challenges, increasing further the projectile weight and cost. As such, the present invention provides an alternative system incorporating more efficient manufacture and reliability, and providing for reduced risk.

Figure 15:
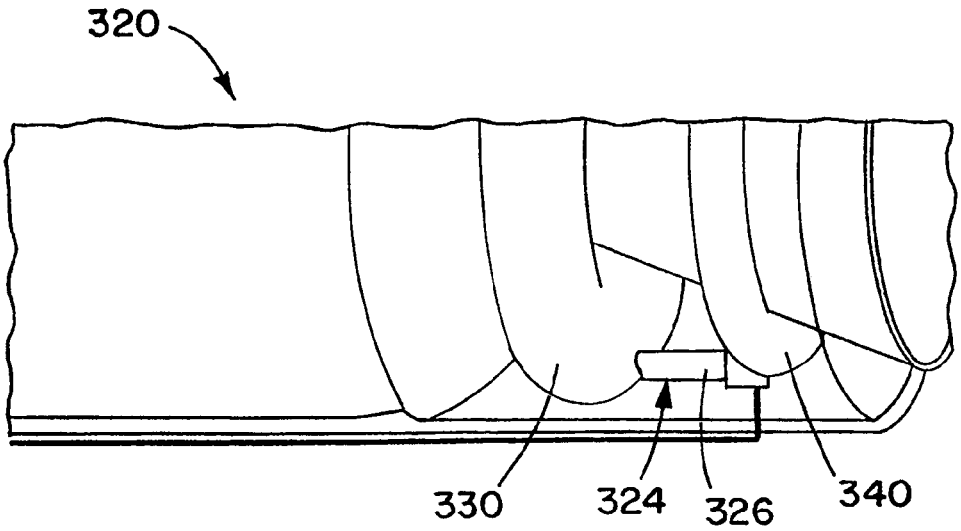
FIG. 15 is a partially transparent side view of part of still another exemplary projectile.
Figure 16:
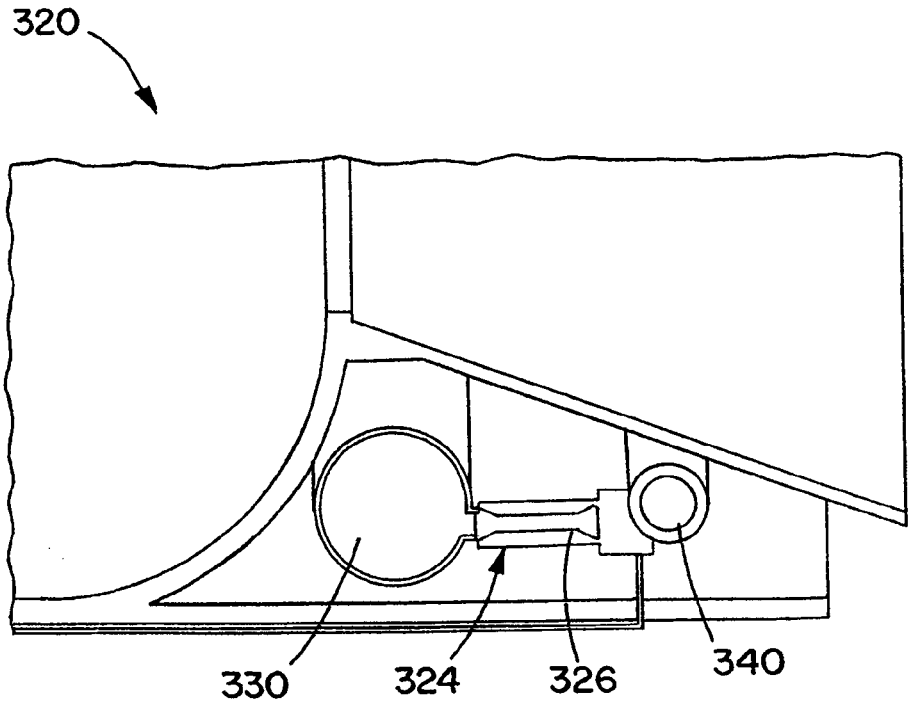
FIG. 16 is a cross-sectional view of the part of the exemplary projectile of FIG. 15.

Turning now to FIGS. 15 and 16, another exemplary projectile 320 having an integrated actuation system 324 is shown. The integrated actuation system 320 may be used in place of any other integrated actuation system described herein and/or features of the integrated actuation systems may be combined.

As shown, the integrated actuation system 324 includes a power generator, such as an electrical generator 326, coupled between a storage reservoir 330 and a manifold 340, providing fluid communication between the two. The electric generator 326, such as a turbine generator, may be used to generate power for the projectile 320. Accordingly, high pressure propellant gases in the storage reservoir 330 may be flashed down to a lower pressure upon entering the manifold 340, thereby transferring kinetic energy to the generator 326 and generating power for other systems of the projectile 320, such as a guidance system controller (not shown). In this way, the need for batteries or other power sources in the projectile is reduced or possibly eliminated.

It will be appreciated that any of the above-mentioned integrated actuation systems may provide for propellant flow between the associated storage reservoirs and any combination of the nozzle actuation system 130 (FIG. 8), stage separation system 230 (FIG. 12), interiorly-located outlets 94 (FIG. 7), peripherally-located outlets 110 (FIG. 7), and manifold 340 and generator 326 (FIG. 15), while omitting propellant flow between any of the listed elements not included in the combination.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A projectile comprising:

a propulsion booster for producing pressurized gases;

a central longitudinal axis that extends through the projectile;

a nozzle for expelling the pressurized gases produced by the booster, the nozzle having a nozzle wall defining a thrust passage for directing a thrust plume of the pressurized gases expelled by the booster, wherein the nozzle wall has an interior surface that faces radially inward towards the axis, wherein the projectile has an exterior surface disposed substantially opposite the interior surface of the nozzle, and wherein the exterior surface faces radially outward away from the axis; and a supplementary integrated actuation system for storing and directing propellant, wherein the integrated actuation system selectively directs the propellant from a storage reservoir of the integrated actuation system to an interior outlet generally disposed near the interior surface, thus changing a direction of the thrust plume, and wherein the integrated actuation system selectively directs the propellant from the storage reservoir to a an exterior outlet generally disposed near the exterior surface, to produce thrust at an external periphery of the projectile, thus diverting the projectile.

2. The projectile as in claim 1, wherein the integrated actuation system further includes:

a first set of supply channels for directing the propellant from the storage reservoir to the interior outlet; and a second set of supply channels for directing the propellant from the storage reservoir to the exterior outlet.

3. The projectile as in claim 2, further including valves for selectively opening the first and second sets of supply channels.

4. The projectile as in claim 1, further including:

a fuselage flange at least partially surrounding the propulsion booster;

wherein the fuselage flange defines an external opening at the external periphery; and wherein the exterior outlet opens to the external opening.

5. The projectile as in claim 1, wherein the propellant is a pressurized liquid.

6. The projectile as in claim 1, wherein the booster contains a thrust supply of propellant separated from the propellant in the storage reservoir, wherein burning of the thrust supply of propellant causes the thrust plume to be outwardly directed from the nozzle wherein injection into the nozzle of propellant from the storage reservoir alters the direction of the thrust plume relative to the central longitudinal axis.

7. The projectile as in claim 1, further including valves that control flow between the storage reservoir and the interior and exterior outlets.

8. The projectile as in claim 1, wherein the storage reservoir extends circumferentially around the nozzle.

9. The projectile as in claim 1, further including:

a power generator for generating electric power for the projectile using propellant from the storage reservoir.

10. The projectile as in claim 9, further including:

a manifold;

wherein the power generator is coupled between the storage reservoir and the manifold; and wherein the power generator generates electric power during flow of propellant between the storage reservoir and the manifold.

11. The projectile as in claim 1, further including:

a nozzle actuation system coupled to the nozzle;

wherein the integrated actuation system selectively directs propellant from the storage reservoir to the nozzle actuation system to position the nozzle.

12. The projectile as in claim 1, further including:

a stage separation system for separating portions of the projectile from one another;

wherein the integrated actuation system selectively directs propellant from the storage reservoir to the stage separation system to selectively separate the portions of the projectile.

13. The projectile as in claim 1, wherein the integrated actuation system further includes a gas generator integral with the storage reservoir for burning propellant in the storage reservoir, thereby releasing gas into the integrated actuation system.

14. An integrated actuation system for a projectile including a body and a nozzle coupled to the body for directing a thrust plume expelled from the body, the integrated actuation system comprising:

a storage reservoir containing propellant;

a central longitudinal axis extending through the integrated actuation system;

a radially inward facing outlet facing radially inward towards the axis and a radially outward facing outlet facing radially outward away from the axis;

an initial flow passage extending between the storage reservoir and the radially inward facing outlet; and an auxiliary flow passage extending between the storage reservoir and the radially outward facing outlet;

wherein propellant from the integrated actuation system is selectively directed through the initial flow passage thereby altering the direction of the thrust plume expelled from the body relative to the central longitudinal axis, or through the auxiliary flow passage thereby altering the attitude and/or roll of the projectile.

15. The integrated actuation system as in claim 14, in combination with a projectile including:

the body;

the nozzle coupled to the body for directing the thrust plume expelled from the body; and a nozzle actuation system;

wherein the integrated actuation system is operatively coupled to the nozzle actuation system for moving the nozzle.

16. The integrated actuation system as in claim 14, in combination with a projectile including:

the body;

the nozzle coupled to the body for directing the thrust plume expelled from the body; and a stage separation system;

wherein the integrated actuation system is operatively coupled to the stage separation system for separating portions of the projectile from one another.

17. The integrated actuation system as in claim 14, wherein the storage reservoir surrounds the nozzle.

18. The integrated actuation system as in claim 14, wherein the propellant is a pressurized fluid.

19. A method of altering a flight vector of a projectile, the method comprising:

maneuvering the projectile by using fluid from a storage reservoir of the projectile;

moving fluid to a radially inward facing outlet that faces radially inward towards a central longitudinal axis that extends through the projectile;

moving fluid to a radially outward facing outlet that faces radially outward away from the central longitudinal axis;

altering the direction of a thrust plume expelling from the nozzle by expelling the fluid from the radially inward facing outlet, and/or altering the attitude and/or roll of the projectile by expelling the fluid from the radially outward facing outlet.

20. The method as in claim 19, further including:

moving the nozzle by moving fluid from a storage reservoir to a nozzle actuation system for moving the nozzle.

* * * * *